US006263625B1

(12) United States Patent
LaPointe

(10) Patent No.: US 6,263,625 B1
(45) Date of Patent: Jul. 24, 2001

(54) STORM PANEL ATTACHMENT SYSTEM

(76) Inventor: Ray A. LaPointe, 388 NE. Surfside Ave., Port St. Lucie, FL (US) 34983

( * ) Notice: Subject to any disclaimer, the term of this patent is extended or adjusted under 35 U.S.C. 154(b) by 0 days.

(21) Appl. No.: 09/300,753

(22) Filed: Apr. 26, 1999

(51) Int. Cl.[7] ..... E06B 9/00
(52) U.S. Cl. ..... 52/202; 52/509; 52/511
(58) Field of Search ..... 52/202, 509, 511

(56) References Cited

U.S. PATENT DOCUMENTS

| | | | | |
|---|---|---|---|---|
| 1,833,998 | | 12/1931 | Kinninger . | |
| 3,188,696 | | 6/1965 | Earhart . | |
| 4,333,271 | | 6/1982 | DePaolo et al. . | |
| 4,452,020 | * | 6/1984 | Werner | 52/202 |
| 4,841,690 | | 6/1989 | Commins . | |
| 5,335,452 | | 8/1994 | Taylor . | |
| 5,343,668 | * | 9/1994 | Gonzalez | 52/202 X |
| 5,347,775 | | 9/1994 | Santos . | |
| 5,596,849 | | 1/1997 | Hill . | |
| 5,722,206 | | 3/1998 | McDonald . | |

* cited by examiner

*Primary Examiner*—Christopher T. Kent
(74) *Attorney, Agent, or Firm*—Edward M. Livingston, Esq.

(57) ABSTRACT

A storm-panel attachment system has at least one storm-panel bracket (1) with an attachment tongue (2) that fits slidably in at least one attachment housing (3) mounted proximate an edge (4) of a building aperture (5) to be storm-paneled. Oppositely disposed proximate a second edge of the building aperture, at least one additional storm-panel bracket has an attachment tongue that fits slidably in at least one other attachment housing. The storm-panel brackets each have at least one brace-attachment appendage (7) to which at least one panel-supportive brace (8) or other panel bracing is fastened. The brace-attachment appendages are sized and shaped for attachment of braces such as two-by-four boards or other structural members to which storm paneling (6) such as plywood sheets, fibrous sheets or aluminum sheets can be nailed, screwed or otherwise affixed. The attachment housings have enclosure walls against which attachment tongues of each attachment housing are buttressed for retaining the storm-panel brackets.

25 Claims, 3 Drawing Sheets

STORM PANEL ATTACHMENT SYSTEM

BACKGROUND OF THE INVENTION

This invention relates to attachments for temporarily positioning storm panels over windows, doors and other structural apertures for protection against hurricanes and other severe storms.

Temporary attachment of storm panels over windows and doors is preferred by many over permanent shutters for aesthetic options and for low cost. Often, however, storm panels are merely nailed to and then un-nailed from building structure in makeshift ways that mar buildings and take much scarce time in emergency conditions. To avoid marring buildings with makeshift attachment of storm panels, temporary panel-attachment systems have been devised. None that are known, however, have a brace-attachment bracket with a tongue-like extension that fits into an attachment enclosure in a manner taught by this invention.

Examples of different but related panel-attachment systems are described in the following patent documents. U.S. Pat. No. 5,722,206, issued to McDonald on Mar. 3, 1998, described use of hinged support braces for supporting bolt-on paneling. U.S. Pat. No. 5,596,849, issued to Hill on Jan. 28, 1997, described a plurality of isosceles trapezoidal shutter panels with interlocking edges and with ends positioned in end caps. U.S. Pat. No. 5,347,775, issued to Santos on Sep. 20, 1994, described a downwardly open channel for receiving a top of a panel at a top of a protected area and a flat rail with fastener holes for supporting a bottom of the panel at a bottom of the protected area. U.S. Pat. No. 5,335,452, issued to Taylor on Aug. 9, 1994, described hurricane panels retained by slide braces in slide-support structure. U.S. Pat. No. 4,841,690, issued to Commins on Jun. 27, 1989, described a sheet-metal connector nailing indicia for nailing on storm panels. U.S. Pat. No. 4,333,271, issued to DePaolo, et al. on Jun. 8, 1982, described a channeled header for receiving hurricane paneling that is fastened to footer sill with fasteners having inside access without outside access to prevent unauthorized removal.

SUMMARY OF THE INVENTION

Objects of patentable novelty and utility taught by this invention are to provide a storm-panel attachment system which:

Does not mar building structure from repeated temporary attachment of storm panels for protection against hurricanes and other severe storms;

Allows storm paneling to be placed over and then removed from windows and doors quickly and easily;

Costs less than permanent shutters;

Does not interfere with aesthetic structure and finishing of buildings;

Does not require cleaning and maintenance like permanent shutters; and

Provides for attachment of whatever type and level of storm protection is desired.

This invention accomplishes these and other objectives with a storm-panel attachment system having at least one first brace-attachment bracket with an attachment tongue that fits slidably in at least one first attachment housing proximate a first edge of a building aperture to be storm-paneled. Oppositely disposed proximate a second edge of the building aperture, at least one second brace-attachment bracket has an attachment tongue that fits slidably in at least one second attachment housing. The brace-attachment brackets each have at least one brace-attachment appendage to which at least one panel-supportive brace is fastened. The brace-attachment appendages are sized and shaped for attachment of braces such as two-by-four boards or other structural members to which hurricane paneling such as plywood sheets, fibrous sheets or aluminum sheets can be nailed, screwed or otherwise affixed. The attachment housings have enclosures with walls against which attachment tongues of each attachment housing are buttressed for retaining the brace-attachment brackets.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

This invention is described by appended claims in relation to description of a preferred embodiment with reference to the following drawings which are described briefly as follows:

DESCRIPTION OF PREFERRED EMBODIMENT

Figure 1:
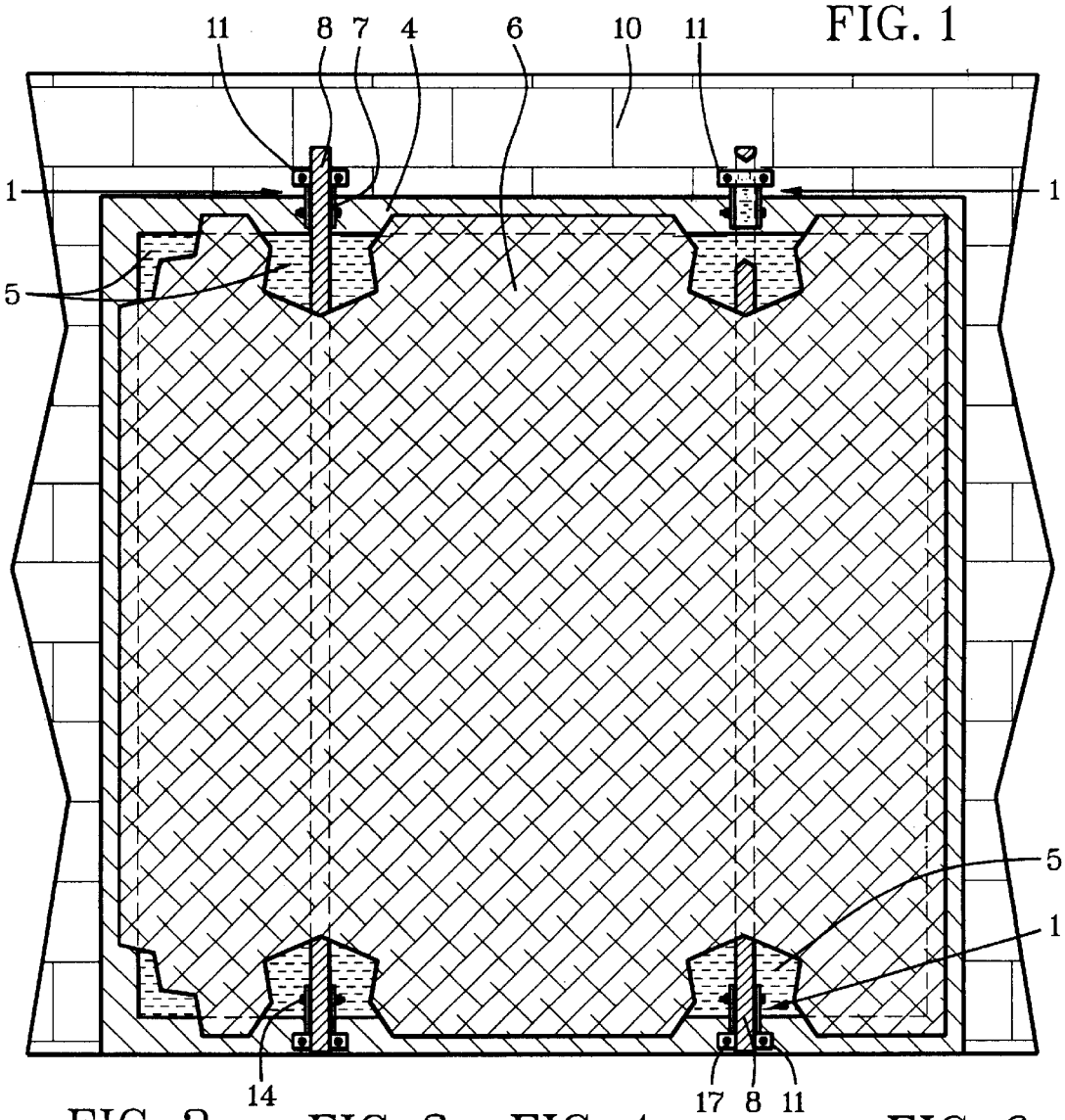
FIG. 1 is a partially cutaway front view of a storm-panel attachment system having vertical panel-supportive braces to which storm paneling is attached to protect glassed building aperture.
Figure 2:
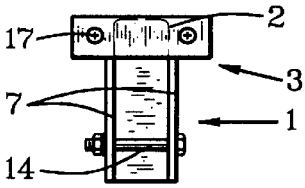
FIG. 2 is a front view of a brace-attachment bracket with an attachment tongue positioned in an attachment housing.
Figure 3:
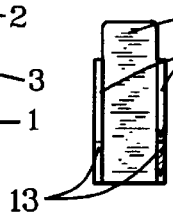
FIG. 3 is a partially cutaway front view of a brace-attachment bracket without an attachment housing and without a brace bolt.
Figure 4:
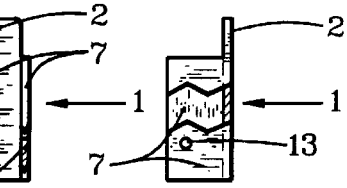
FIG. 4 is a partially cutaway side view of a brace-attachment bracket.
Figure 6:
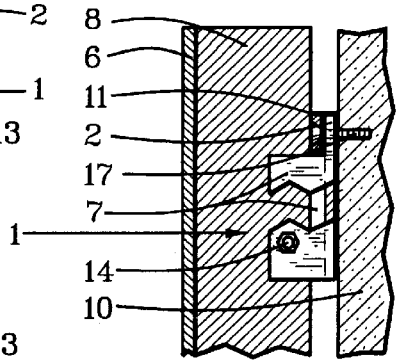
FIG. 6 is a partially cutaway side view of a portion of a panel-supportive brace to which storm paneling is affixed and which is attached to a portion of a building wall with a brace-attachment bracket.
Figure 5:
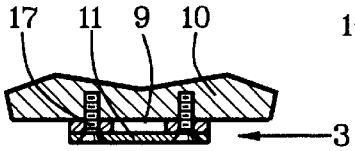
FIG. 5 is a partially cutaway top view of an attachment housing affixed to a portion of a building wall.

Terms used to describe features of this invention are listed below with numbering in the order of their initial use with reference to the drawings. These terms and numbers assigned to them designate the same features wherever used throughout this description.

1. Storm-panel bracket
2. Attachment tongue
3. Attachment housing
4. Edge of building aperture
5. Building aperture
6. Storm paneling
7. Brace-attachment appendage
8. Panel-supportive brace
9. Attachment aperture
10. Building wall
11. Housing plate
12. Attachment surface
13. Fastener receptacle
14. Panel fastener
15. Rod
16. Rod receptacle
17. Housing fastener
18. Panel-attachment appendage
19. Removable brace wall
20. Wall pivot
21. Wall fastener
22. Fastener bay
23. Panel-attachment angle
24. Brace-attachment angle
25. Straight attachment
26. Panel attachment Referring first to FIGS. 1–6, a storm-panel bracket 1, which is one of a plurality of storm-panel brackets 1, has an attachment tongue 2 that fits slidably in an attachment housing 3, which is one of a plurality of attachment housings 3, proximate an edge 4 of a building aperture 5 that is intended to be storm paneled with storm paneling 6. The storm-panel bracket 1 has at least one brace-attachment appendage 7 to which at least one panel-supportive brace 8 is affixable.

The attachment tongue 2 is preferably a flatly rectangular member and the attachment housing 3 has a matching attachment aperture 9 into which the attachment tongue 2 fits slidably. The attachment aperture 9 is flatly rectangular intermediate a building wall 10 and an inside surface of a housing plate 11 attached to the building wall 10.

Figure 7:
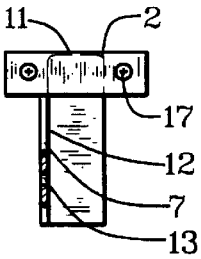
FIG. 7 is a partially cutaway front view of a brace-attachment bracket having a single brace-attachment appendage and having an attachment tongue in an attachment housing.
Figure 8:
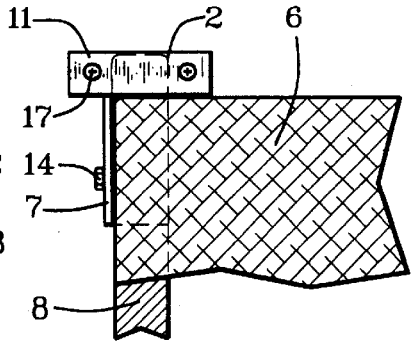
FIG. 8 is the FIG. 7 illustration to which a panel-supportive brace with storm paneling is affixed.

Referring to FIGS. 7–8, the at least one brace-attachment appendage 7 on the storm-panel bracket 1 can be a single brace-attachment appendage 7 with at least one attachment surface 12 that is sized and shaped to fit against at least one panel-supportive brace 8 that has at least one fastener receptacle 13 for attachment of storm paneling 6 with a panel fastener 14. For the storm-panel bracket 1 described in relation to FIGS. 1–6, there are two brace-attachment appendages 7 that are spaced apart to receive a panel-supportive brace 8 such as a two-by-four board to which storm-paneling 6 such as five-eights plywood sheets can be nailed or otherwise affixed. A selection of brace-attachment appendages 7 and their positioning on the storm-panel bracket 1 is provided to accommodate attachment of a selection of storm-paneling 6 with different sizes and shapes that can be attached directly to the storm-panel bracket 1 or that can be attached to the panel-supportive brace 8.

Figure 9:
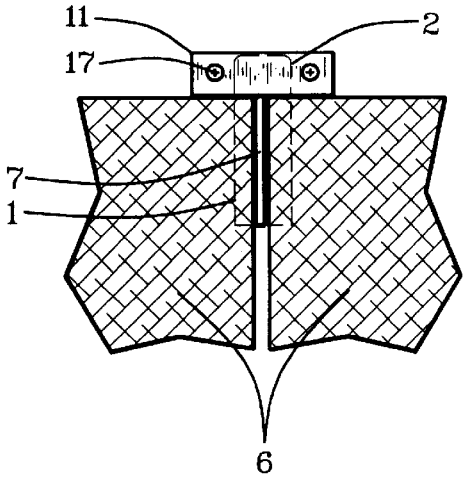
FIG. 9 is a partially cutaway front view of a brace-attachment bracket having a single brace-attachment appendage that is centrally positioned and having an attachment tongue in an attachment housing.

Referring to FIG. 9, a single brace-attachment appendage 7 can be centrally positioned on the storm-panel bracket 1 to provide attachment of storm paneling 6 to either or both sides.

One common use of this storm-panel attachment system initially will be for two-by-four boards as panel-supportive braces 8 and plywood sheets as storm paneling. For this use, the embodiment described in relation to FIGS. 1–6 will be employed.

However, it is intended and anticipated that storm paneling 6 made of different materials such as fiberglass, jute-reinforced resin and aluminum will be used increasingly. These materials can have panel-supportive bracing, whether or not separate panel-supportive braces 8, built into them as substitutions of equivalents for panel-supportive braces 8. Fasteners for different storm paneling 6 will be designed accordingly within the intent of this invention. Hence, the description of this invention in relation to FIGS. 7–11.

Figure 10:
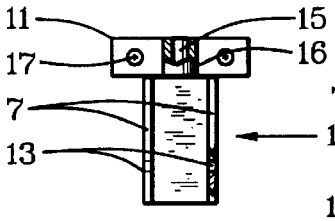
FIG. 10 is a front view of a brace-attachment bracket with a cylindrical attachment tongue positioned in a cylindrical attachment housing.
Figure 11:
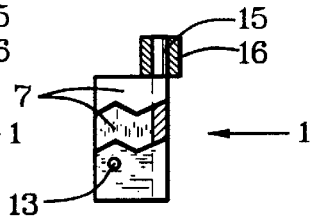
FIG. 11 is a partially cutaway side view of the FIG. 10 illustration.

Referring to FIG. 10–11, the at least one attachment tongue 2 described in relation to FIGS. 1–9 can be a rod 15 having a predetermined size and shape to fit slidably into a matching rod receptacle 16. A cylindrical rod 15 and matching rod receptacle 16 is representative of a selection of cross sections of rods for particular use conditions.

Figure 12:
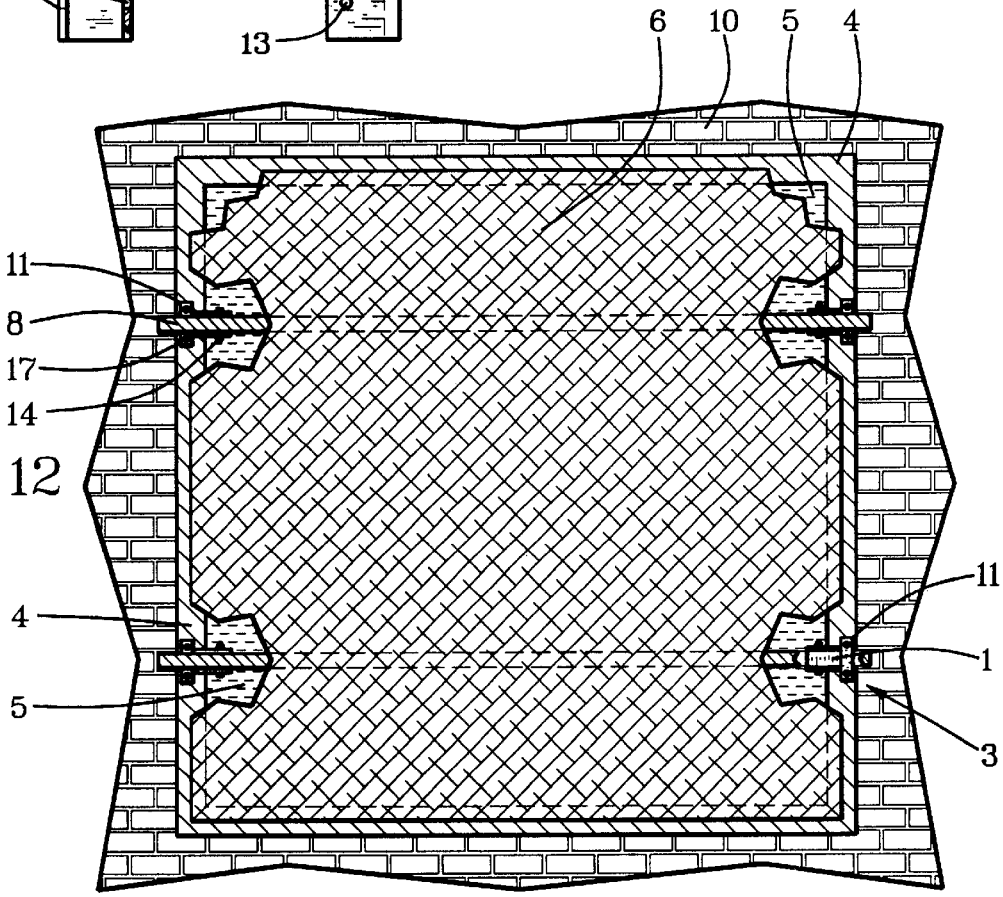
FIG. 12 is a partially cutaway front view of a storm-panel attachment system having horizontal panel-supportive braces to which storm paneling is attached to protect a glassed building aperture.

The panel-supportive braces 8 can be oriented horizontally as depicted in FIG. 12 or vertically as shown in FIG. 1. First edges and second edges of the building aperture 5 indicate use of the storm-panel brackets 1 in one or more pairs of two with either top-and-bottom or opposite-side edges 4 for either a first or a second storm-panel bracket 1.

Panel fasteners 14 for attachment of either panel-supportive braces 8 or bracing portions of storm paneling 6 can be any appropriate fastener. Quick-disconnect fasteners of select designs are anticipated and intended to be represented by the bolt and nut depicted. Similarly, housing fasteners 17 depicted as flathead countersunk bolts are representative of fasteners that are appropriate for particular structure of building walls 10. Affixing the attachment housing 3, described in relation to FIG. 1, to a building wall 10 can be permanent or, alternatively, a fastener-holder, such as an internally threaded member, can be positioned in brick, cement block, wood, fibrous or other building material from which the building wall 10 is constructed.

Referring to FIGS. 13–18, the storm-panel bracket 1 can have a panel-attachment appendage 18 extended from an attachment tongue 2 that fits slidably in an attachment aperture 9 that has a removable brace wall 19 which is pivotal or otherwise removable to receive the attachment tongue 2 laterally without being slid in or out. Removability of the removable brace wall 19 is preferably pivotal with a wall pivot 20 on which the removable brace wall 19 is pivotal between an open mode as shown in dashed lines in FIGS. 13–14 and 17–18 and a closed mode as shown in solid lines in FIGS. 13–18. Proximate an opposite side of the attachment aperture 9 from the wall pivot 20 is a wall fastener 21 with which the removable brace wall 19 is fastened in a closed mode or unfastened to be pivoted to an open mode.

Figure 13:
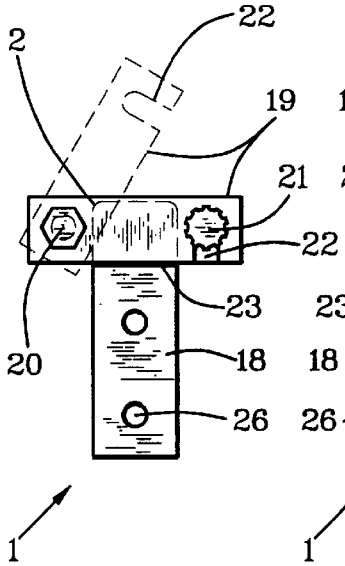
FIG. 13 is a front elevation view of a storm-panel attachment system having an attachment aperture with a removable brace wall.
Figure 16:
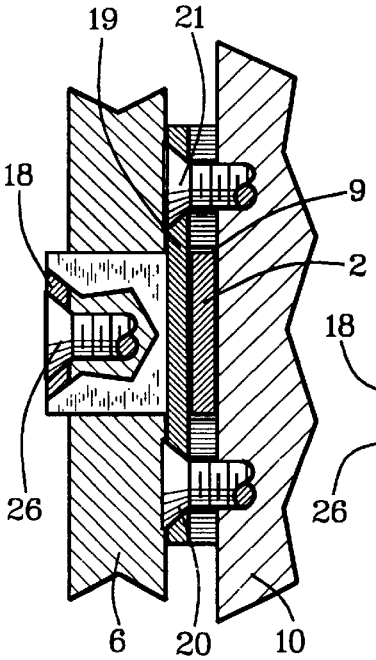
FIG. 16 is a partially cutaway and exploded top view of the FIG. 15 illustration with a wall pivot and a wall fastener countersunk into a removable brace wall.

The wall pivot 20 can be a shaft such as a bolt shaft with a hex head as depicted in FIG. 13 or a bolt with a countersunk head that is countersunk into the removable brace wall 19 as depicted in FIG. 16. The wall fastener 21 can be a bolt with a hand-rotatable bolt as depicted in FIG. 13 or a bolt with a countersunk head that is countersunk in the removable brace wall 19 as depicted in FIG. 16. Preferably for pivotal removability of the removable brace wall 19, a fastener bay 22 is provided as shown in FIG. 13.

Figure 14:
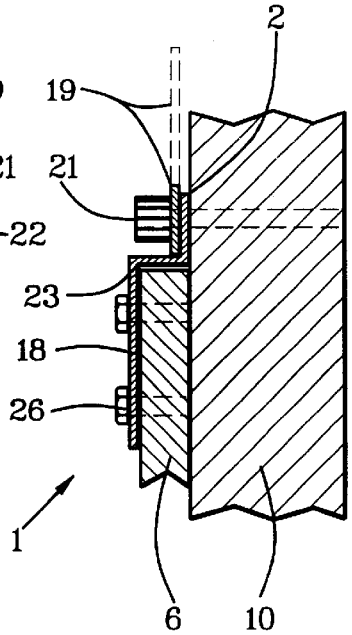
FIG. 14 is a side view of the FIG. 13 illustration of the storm-panel attachment system with a storm panel attached to a wall.
Figure 15:
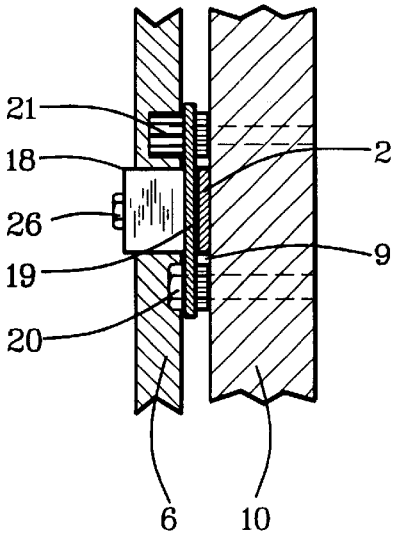
FIG. 15 is a top view of the FIG. 14 illustration.
Figure 17:
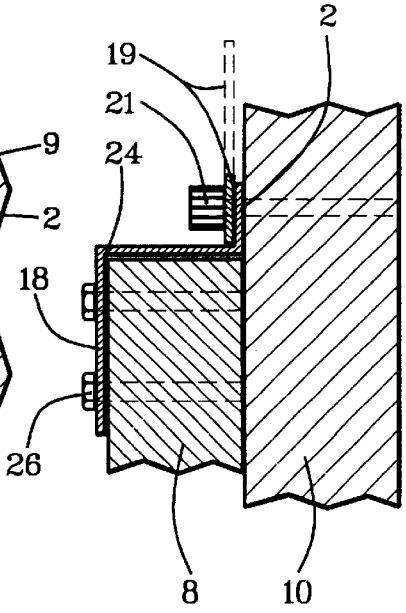
FIG. 17 is a side view of the FIG. 14 illustration of the storm-panel attachment system with a storm panel-supportive brace attached to a building wall.
Figure 18:
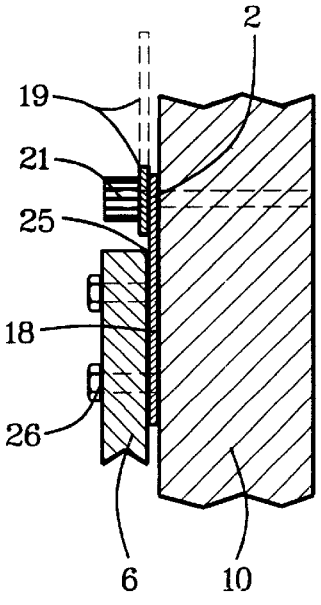
FIG. 18 is a side view of a storm-panel attachment system having a storm panel attached to a building wall with a straight attachment.

The panel-attachment appendage 18 can have a panel-attachment angle 23 that is sized and shaped orthogonally to receive an attachment portion of the storm paneling 6 as shown in FIG. 14, a brace-attachment angle 24 that is sized and shaped orthogonally to receive an attachment portion of the storm paneling 6 as shown in FIG. 17, or a straight attachment 25 that is sized and shaped for juxtaposed positioning of the storm paneling 6 as shown in FIG. 18 or for juxtaposed positioning of a panel-supportive brace 8.

A panel attachment 26, such as bolt holes depicted in FIG. 13 for fasteners depicted in FIGS. 14–18 can be employed for attaching storm paneling 6 or panel-supportive braces 8 to either the panel-attachment angle 23, the brace-attachment angle 24 or the straight attachment 25.

A new and useful storm-panel attachment system having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A storm-panel attachment system comprising:

at least one first storm-panel bracket with an at least first attachment tongue;

an at least one first attachment housing for placement proximate a first edge of a building aperture that is intended to be storm-paneled into which the at least first attachment tongue fits slidably;

the first storm-panel bracket having an at least one brace-attachment appendage;

an at least one panel-supportive brace affixable to the first storm-panel bracket;

at least one second storm-panel bracket with an attachment tongue;

at least one second attachment housing for placement proximate a second edge of the building aperture into which the attachment tongue slidably fits; and the second storm-panel bracket having an at least one brace-attachment appendage to which the at least one panel-supportive brace is affixable.

2. A storm-panel attachment system as described in claim 1 wherein:

the at least first attachment tongue is a flatly rectangular member; and the at least one first attachment housing has a flatly rectangular attachment aperture into which the attachment tongue of the at least one first storm-panel bracket fits slidably.

3. A storm-panel attachment system as described in claim 2 wherein:

the flatly rectangular attachment aperture is intermediate a building wall proximate the first edge of the building aperture and an inside surface of a housing plate attached to the building wall.

4. A storm-panel attachment system as described in claim 1 wherein:

at least the first attachment tongue is a rod having a predetermined size and shape; and at least the first attachment housing has a rod receptacle that is sized and shaped to receive the rod slidably.

5. A storm-panel attachment system as described in claim 1 wherein:

the at least one brace-attachment appendage is a single brace-attachment appendage that is flatly rectangular with at least one attachment surface that is sized and shaped to fit against at least one panel-supportive brace; and the single brace-attachment appendage has at least one fastener receptacle for containing at least one fastener with which the panel-supportive brace is attachable to the single brace-attachment appendage.

6. A storm-panel attachment system as described in claim 1 wherein:

the at least one brace-attachment appendage is a pair of two brace-attachment appendages that are flatly rectangular and have attachment surfaces that are sized, shaped and spaced apart to fit against surfaces of at least one panel-supportive brace; and the pair of two brace-attachment appendages have at least one fastener receptacle for containing at least one fastener with which the panel-supportive brace is attachable to the pair of two brace-attachment appendages.

7. A storm-panel attachment system as described in claim 1 wherein:

the panel-supportive brace is a standard structural wooden board to which storm paneling can be affixed.

8. A storm-panel attachment system as described in claim 1 wherein:

the panel-supportive brace is a fibrous bar to which storm paneling can be affixed.

9. A storm-panel attachment system as described in claim 1 wherein:

the panel-supportive brace is a metallic bar to which storm panels can be affixed.

10. A storm-panel attachment system as described in claim 1 wherein:

at least the first brace-attachment appendage has at least one fastener aperture into which a fastener bolt can be inserted; and the panel-supportive brace has at least one fastener aperture into which the fastener bolt can be inserted for attachment of the panel-supportive brace to the brace-attachment appendage.

11. A storm-panel attachment system comprising:

at least one first storm-panel bracket with an attachment tongue;

at least one first attachment housing for placement proximate a first edge of a building aperture that is intended to be storm-paneled into which the at least first attachment tongue fits slidably;

the first storm-panel bracket having a first pair of two brace-attachment appendages that are flatly rectangular and have attachment surfaces that are sized, shaped and spaced apart to fit against surfaces of at least one panel-supportive brace;

at least one panel supportive brace affixable to the first storm-panel bracket:

at least one second storm-panel bracket with an attachment tongue;

at least one second attachment housing for placement proximate a second edge of the building aperture into which the attachment tongue slidably fits;

the second storm-panel bracket having a pair of two brace-attachment appendages that are flatly rectangular and have attachment surfaces that are sized, shaped and spaced apart to fit against surfaces of the at least one panel-supportive brace;

at least the first pair of brace-attachment appendages having at least one fastener aperture into which a fastener bolt can be inserted; and the panel-supportive brace having at least one fastener aperture into which the fastener bolt can be inserted for attachment of the panel-supportive brace to the brace-attachment appendage.

12. A storm-panel attachment system as described in claim 11 wherein:

at least the first attachment tongue is a flatly rectangular member; and at least the first attachment housing has a flatly rectangular attachment aperture into which the attachment tongue of the first storm-panel bracket fits slidably.

13. A storm-panel attachment system as described in claim 12 wherein:

the flatly rectangular attachment aperture is intermediate a building wall proximate the first edge of the building aperture and an inside surface of a housing plate attached to the building.

14. A storm-panel attachment system as described in claim 11 wherein:

at least the first attachment tongue is a rod having a predetermined size and shape; and at least the first attachment housing has a rod receptacle that is sized and shaped to receive the rod slidably.

15. A storm-panel attachment system as described in claim 11 wherein:

the panel-supportive brace is a standard structural wooden board to which storm paneling can be affixed.

16. A storm-panel attachment system as described in claim 11 wherein:

the panel-supportive brace is a fibrous bar to which storm paneling can be affixed.

17. A storm-panel attachment system as described in claim 11 wherein:

the panel-supportive brace is a metallic bar to which storm paneling can be affixed.

18. A storm-panel attachment system as described in claim 1 wherein:

at least one panel-supportive brace is pre-affixed to storm paneling.

19. A storm-panel attachment system as described in claim 18 wherein:

the first storm-panel bracket is attachable to the attachment housing with a quick-disconnect fastener; and the second storm-panel bracket is attachable to the attachment housing with a quick-disconnect fastener.

20. A storm-panel attachment system as described in claim 1 wherein:

the first attachment housing is attached to a building wall with a quick-disconnect fastener; and the second attachment housing is attached to a building wall with a quick-disconnect fastener.

21. A storm-panel attachment system comprising:

at least one storm-panel bracket with an attachment tongue that fits slidably in an attachment housing for placement proximate at least one edge of a building aperture that is intended to be storm-paneled;

a panel-attachment appendage extended from the attachment tongue;

at least one panel attachment on the panel-attachment appendage;

wherein the attachment housing has an attachment aperture that is rectangularly flat; and the attachment tongue is a rectangularly flat member that fits slidably in the attachment aperture.

22. A storm-panel attachment system as described in claim 21 wherein:

the attachment housing has a removable brace wall that is removable to receive the attachment tongue; and the removable brace wall has a wall fastener for fixing the removable wall to the attachment tongue.

23. A storm-panel attachment system as described in claim 22 wherein:

the removable brace wall has a wall pivot proximate a first side and a wall fastener proximate a second side of the attachment aperture.

24. A storm-panel attachment system as described in claim 23 wherein:

the wall pivot and the wall fastener are countersunk into the removable brace wall.

25. A storm-panel attachment system as described in claim 21 wherein:

the panel-attachment appendage has a brace-attachment angle that is sized and shaped orthogonally to receive an attachment portion of the panel-supportive brace.

* * * * *